US012578140B1

(12) United States Patent
Shorette

(10) Patent No.: US 12,578,140 B1
(45) Date of Patent: Mar. 17, 2026

(54) COOLING CABINET

(71) Applicant: Marie Shorette, North Grafton, MA (US)

(72) Inventor: Marie Shorette, North Grafton, MA (US)

( * ) Notice: Subject to any disclaimer, the term of this patent is extended or adjusted under 35 U.S.C. 154(b) by 252 days.

(21) Appl. No.: 18/124,698

(22) Filed: Mar. 22, 2023

(51) Int. Cl.
*F25D 23/06* (2006.01)
*F25B 39/04* (2006.01)
*F25D 17/06* (2006.01)

(52) U.S. Cl.
CPC ..... *F25D 23/063* (2013.01); *F25B 39/04* (2013.01); *F25D 17/06* (2013.01)

(58) Field of Classification Search
CPC ..... F25D 23/062; F25D 23/06
See application file for complete search history.

(56) References Cited

U.S. PATENT DOCUMENTS 6,422,031 B1 7/2002 Mandel et al.
9,890,984 B2 2/2018 Kim et al.
11,559,161 B1 * 1/2023 Nappi ..... A47J 27/004
2008/0163628 A1 * 7/2008 Lilke ..... F25D 31/007 312/401
2021/0063062 A1 * 3/2021 Alexander ..... A01N 1/144
2022/0361667 A1 * 11/2022 Cornell ..... A47B 46/00
2023/0157475 A1 * 5/2023 Nappi ..... F25B 21/04 426/523
2024/0285096 A1 * 8/2024 Lucas ..... A47F 3/005

FOREIGN PATENT DOCUMENTS

CN 213959518 U * 8/2021
DE 102008053958 A1 * 5/2010 ..... H05K 7/206

OTHER PUBLICATIONS

Xu (CN213959518U), English Translation, Intelligent remote monitoring distribution box, Whole Document (Year: 2021).*

* cited by examiner

*Primary Examiner* — Jerry-Daryl Fletcher
*Assistant Examiner* — Keith Stanley Myers
(74) *Attorney, Agent, or Firm* — Sanchelima & Associates, P.A.; Jesus Sanchelima; Christian Sanchelima

(57) ABSTRACT

A cooling cabinet including a base assembly, a sidewalls assembly, a rear wall assembly and a lid assembly. The base assembly, the rear wall assembly and the sidewalls assembly are attached together defining the cabinet. The base assembly includes a base having a cooling condenser. The cooling condenser dispenses a cool flow of air. The sidewalls assembly includes sidewalls having rectangular elongated portions opposite therebetween defining shelves. The sidewalls are in fluid communication with the base. The cool flow of air is dispensed through the sidewalls. The lid assembly includes a lid. The lid is rotatably attached to the sidewalls defining an open configuration and a closed configuration.

20 Claims, 5 Drawing Sheets

COOLING CABINET

II. BACKGROUND OF THE INVENTION

1. Field of the Invention

The present invention relates to a cooling cabinet and, more particularly, to a cooling cabinet that can be used for evenly cooling contents displaced in trays.

2. Description of the Related Art

Several designs for coolers have been designed in the past. None of them, however, include hollow sidewalls to permit air flow to go through.

Applicant believes that a related reference corresponds to U.S. Pat. No. 9,890,984 issued for a super cooling refrigerator. Applicant believes that another related reference corresponds to U.S. Pat. No. 6,422,031 issued for a refrigeration appliance with impingement cooling. None of these references, however, teach of a cooling cabinet having multiple compartments to insert trays therein, where the trays include slots to permit cooling flow of air to go therethrough to cool content placed over the trays.

Other documents describing the closest subject matter provide for a number of more or less complicated features that fail to solve the problem in an efficient and economical way. None of these patents suggest the novel features of the present invention.

III. SUMMARY OF THE INVENTION

It is one of the objects of the present invention to provide a cooling cabinet having a cooling unit placed on the base thereof, where the cooling air from the cooling unit is evenly dispensed in each of the shelves within the cabinet.

It is another object of this invention to provide a cooling cabinet that includes a door pivotally attached to the cabinet.

It is another object of this invention to provide a cooling cabinet that is easy to assemble, use, and store away.

It is still another object of the present invention to provide a cooling cabinet including sidewalls and rear walls mountable to a base, where the base includes the air cooling unit.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

IV. BRIEF DESCRIPTION OF THE DRAWINGS

With the above and other related objects in view, the invention consists in the details of construction and combination of parts as will be more fully understood from the following description, when read in conjunction with the accompanying drawings in which.

Figure 2:
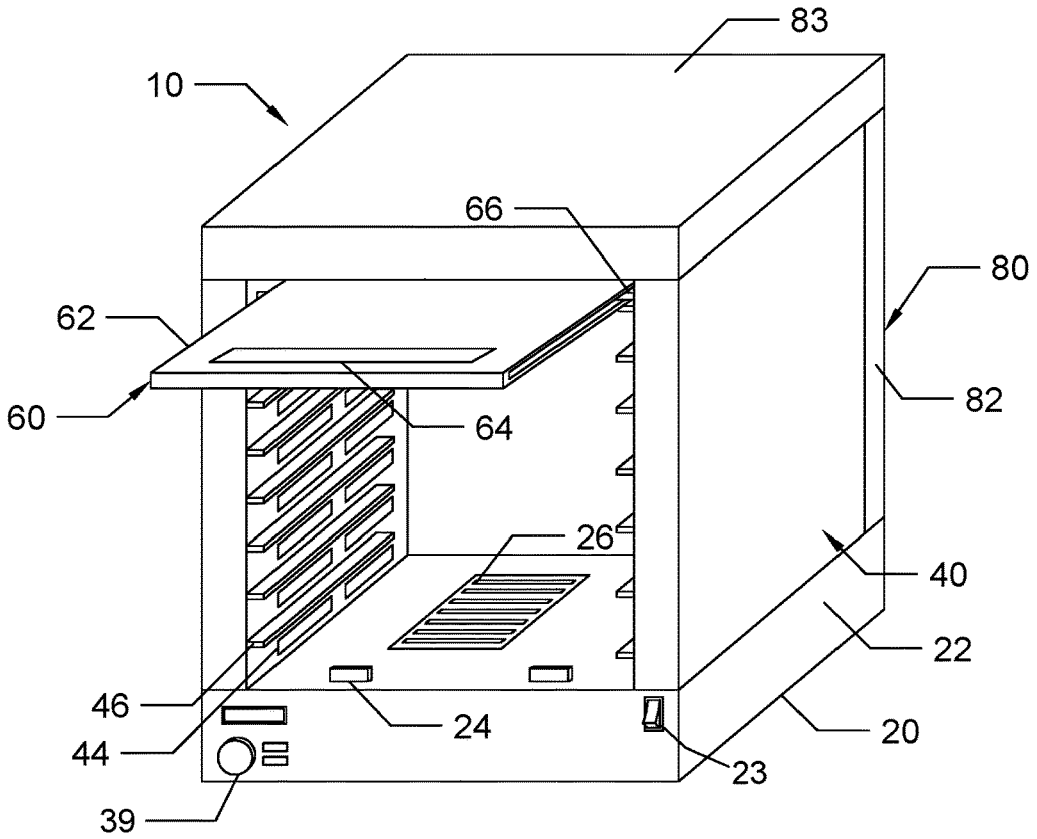

FIG. 2 shows an isometric view of the present invention 10 having the door 62 opened. The present invention 10 includes a base assembly 20, a sidewalls assembly 40, a lid assembly 60, and a rear wall assembly 80.

Figure 3:
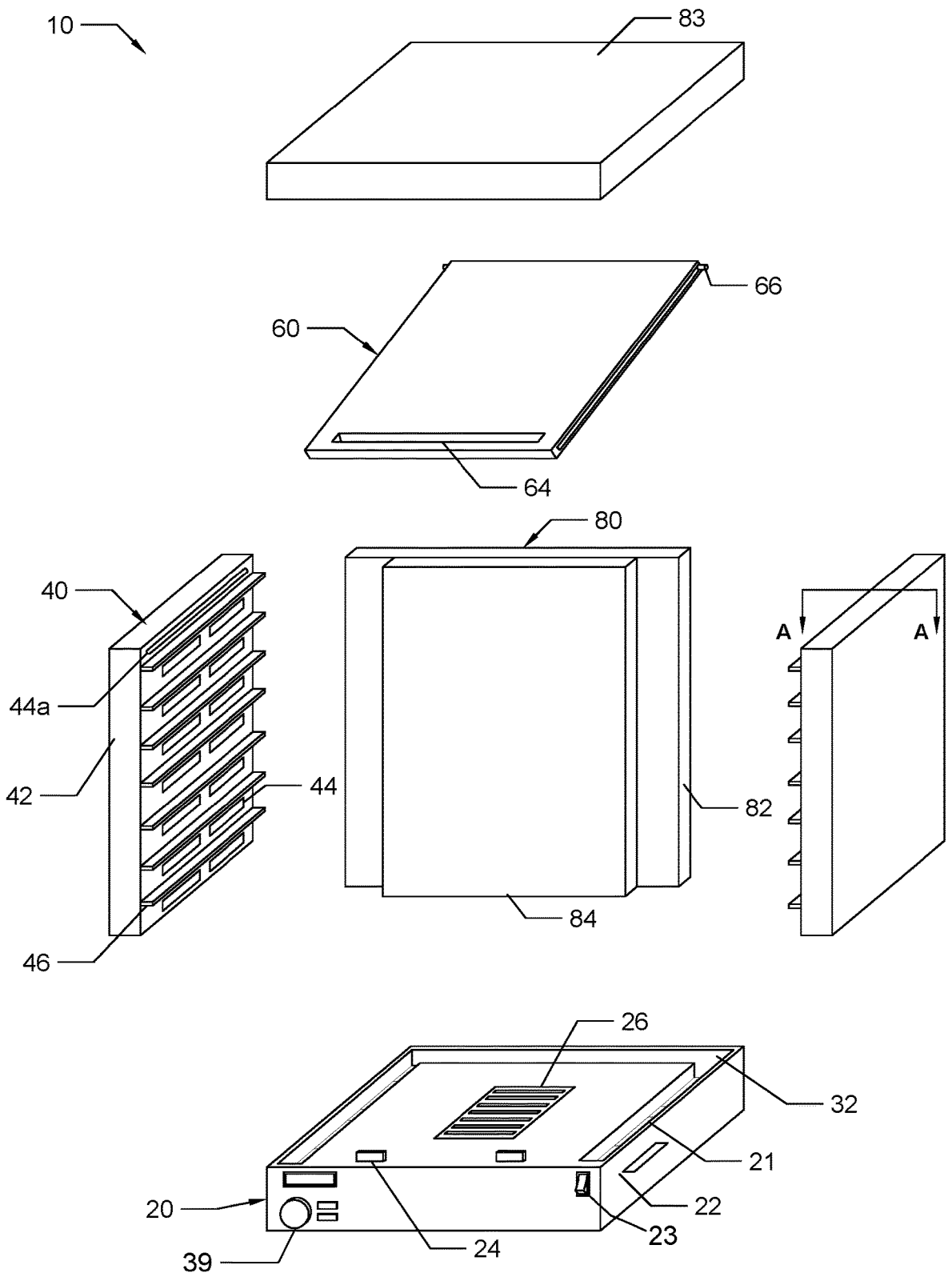

FIG. 3 illustrates an exploded view of the present invention 10.

Figure 4:
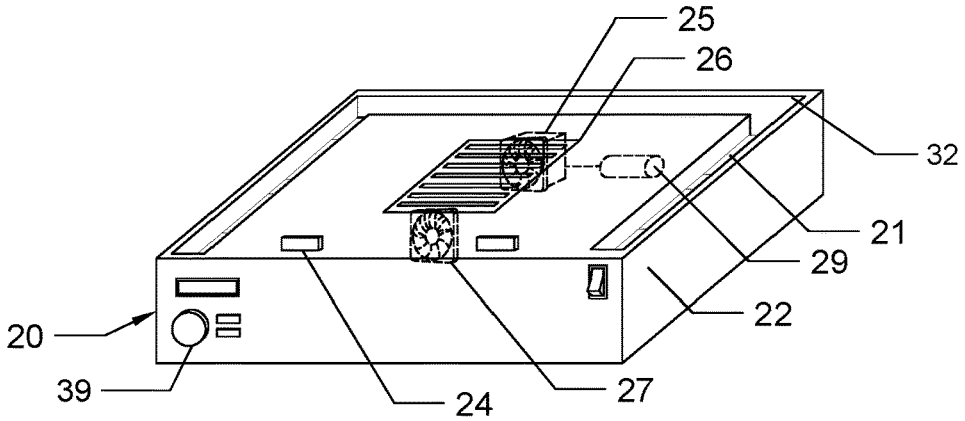

FIG. 4 is a representation of a see-through view of the base assembly 20.

Figure 5:
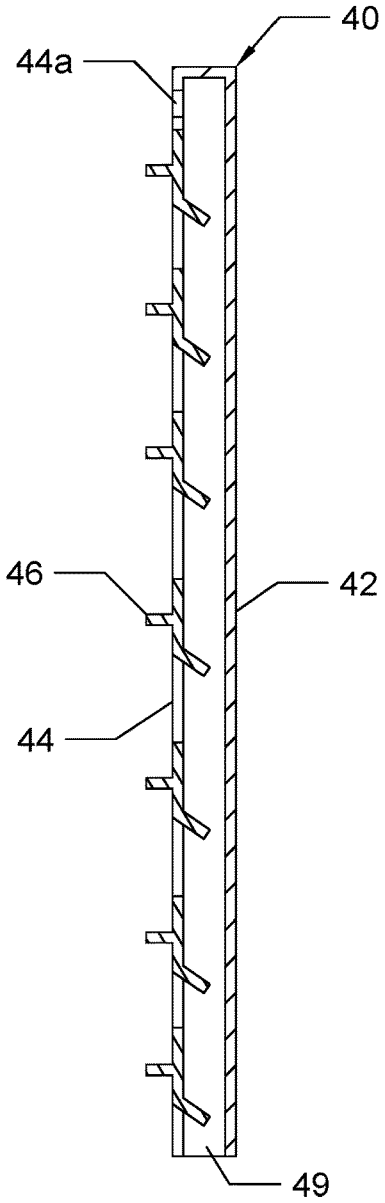

FIG. 5 depicts a cross sectional view A-A of the one of the sidewalls 42.

Figure 6:
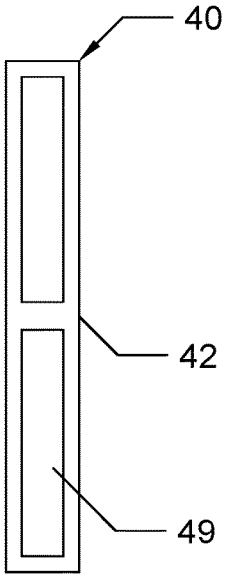

FIG. 6 shows a bottom view of the sidewalls assembly 40 showing third openings 49.

Figure 7:
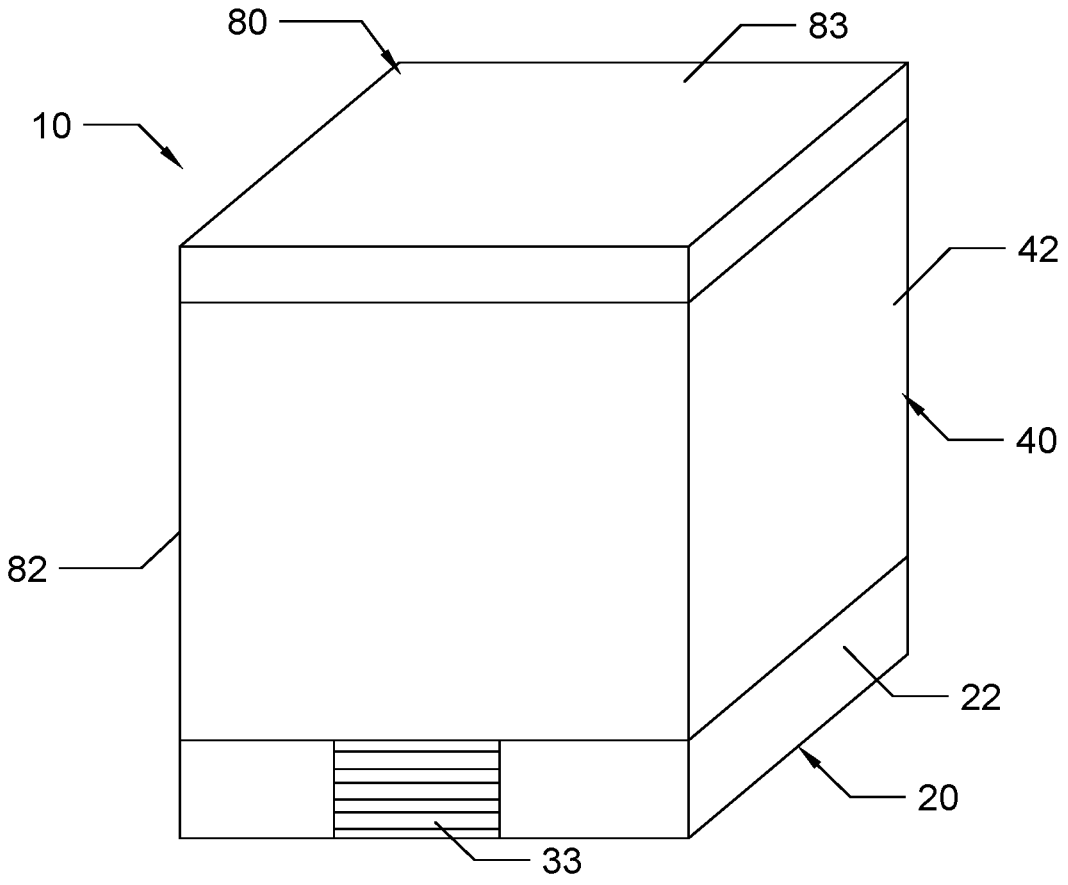

FIG. 7 is an illustration of a rear perspective view of the present invention 10 showing a vent 33.

V. DETAILED DESCRIPTION OF THE EMBODIMENTS OF THE INVENTION

Referring now to the drawings, where the present invention is generally referred to with numeral 10, it can be observed that it basically includes a base assembly 20, a sidewalls assembly 40, a lid assembly 60, and a rear wall assembly 80. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

As best illustrated in FIG. 4 the base assembly 20 may include a base 22, first openings 21, stops 24, a fan 27, a grid 26, a cooling condenser 25, a control panel 39, a motor 29, a channel 32, and a switch 23. The base 22 may have a rectangular shape. It also may be suitable for the base 22 to have a cylindrical shape, an oval shape, or any other shape. The base 22 may be made of polyurethane, polyvinyl chloride, stainless steel, or any other suitable material. The base 22 may have the first openings 21 on a top-left portion and a top-right portion thereof. It may be suitable for the base 22 to include a plurality of legs to support and provide a separation with a surface where the base 22 is placed. The first openings 21 may have a predetermined separation therebetween. The first openings 21 may be in a bottom wall of channel 32. Channel 32 may have a rectangular shape. Channel 32 may be a rectangular opening extending a length of a left portion, rear portion and right portion of the base 22.

The stops 24 may be located on a top-front portion of the base 22. The stops 24 may have a rectangular shape. The base 22 may be hollow. The grid 26 may be located on a central-top portion of the base 22. The grid 26 may allow air flow therethrough. The fan 27 and the cooling condenser 25 may be located within the base 22.

The cooling condenser 25 may be actuated to dispense a cool flow of air. It should be understood that cooling condenser 25 may use any cooling technology known in the prior art. The cooling condenser 25 may be connected to alternate current. The cool flow of air may be dispensed through grid 26. Furthermore, the cool flow of air may be circulated through the first openings 21 by means of fan 27. Fan 27 may be located on a front-inner portion of the base 22. Fan 27 may be any fan known in the prior art for cooling units. Both fan 27 and cooling condenser 25 may be operatively connected to a power source. The switch 23 may be located on a front wall of the base 22. The switch 23 may be operated to actuate the cooling condenser 25 and the fan 27.

In a preferred embodiment the control panel 39 may be located in the front wall of the base 22. The control panel 39 may be used to control a temperature, speed of the fan 27, and a predetermined time for the fan 27 and the cooling condenser 25 to operate. It should be understood that additional elements may be controlled through the control panel 39. In a preferred embodiment the control panel 39 may include a knob, buttons and a display. The buttons may be used to select a predetermined setting, the knob may be used to modify a predetermined temperature or a time. The base 22 may further include vents 33 to allow dissipating heat from the cooling condenser 25. The vents 33 may be placed along the base 22. As best illustrated in FIG. 7 one of the vents 33 may be located on a rear wall of the base 22.

Referring now to FIG. 3 and FIG. 6 it can be observed that the sidewalls assembly 40 may include sidewalls 42, second openings 44, third openings 49, shelves 46 and slots 44*a*. In a preferred embodiment each of the sidewalls 42 may have a rectangular shape. It also may be suitable for each of the sidewalls 42 to have a cylindrical shape, an oval shape, or any other suitable shape. The sidewalls 42 may be made of polyvinyl chloride, polyurethane, stainless steel, or any other resistant mate. The sidewalls 42 may be hollow. The second openings 44 may be disposed on one of the lateral walls of each of the sidewalls 42. In The sidewalls 42 may preferably include a left wall and a right wall. The left wall of the sidewalls 42 may have the second openings 44 equidistantly disposed on a right wall thereof. The right wall of the sidewalls 42 may have the second openings 44 disposed on a left wall thereof. The second openings 44 may have a rectangular shape. The second openings 44 may dispense the cool flow of air therethrough.

The third openings 49 may be located on a bottom wall of the sidewalls 42. The third openings 49 may be coupled with the first openings 21 to permit cool air to flow from the base 22 to the sidewalls 42 and be dispensed through the second openings 44. The shelves 46 may be protruding elements that protrude from each of the sidewalls opposite to each other. The shelves 46 may have a rectangular elongated shape. The shelves 46 may be horizontally aligned as best illustrated in FIG. 5. The slots 44*a* may substantially have a rectangular elongated shape. The slots 44*a* may extend a length of the top end of each of the sidewalls 42. The slots 44*a* may be diametrically opposite one to the other, as best illustrated in FIG. 3. The slots 44*a* may allow the lid assembly 60 to open and close defining an open configuration and a closed configuration.

Figure 1:
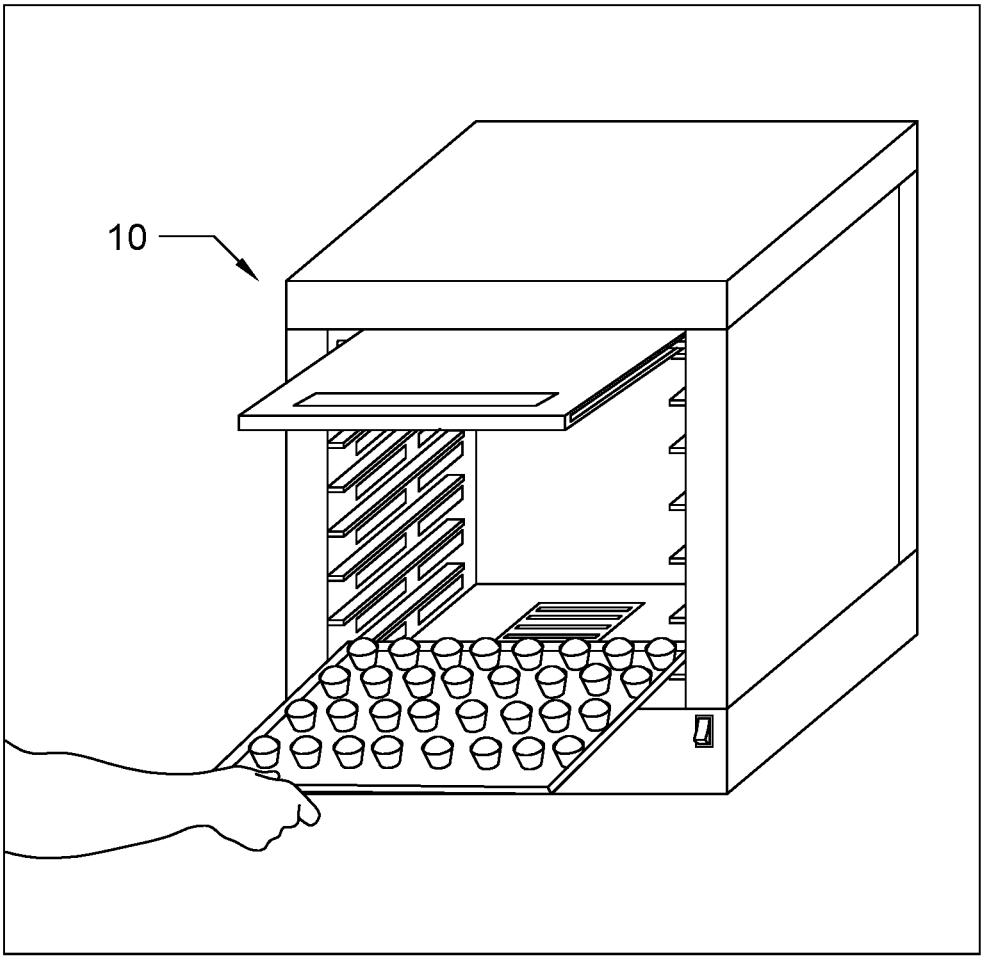
FIG. 1 represents an isometric operational view of the present invention 10 in use for cooling a predetermined food.
Figure 1A:
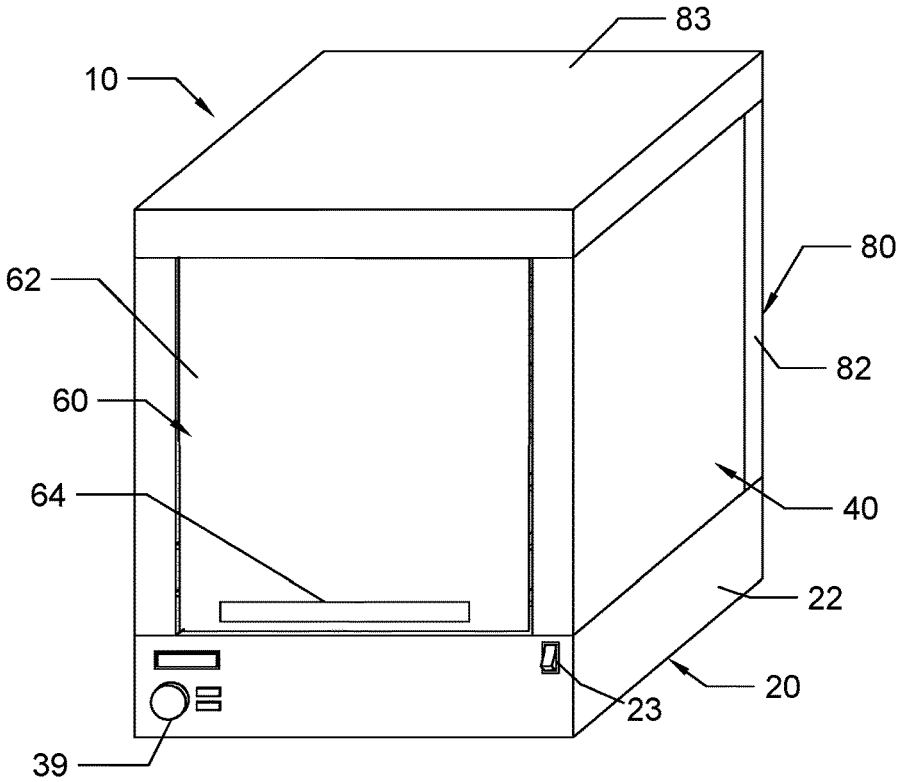
FIG. 1A depicts an isometric view of the present invention 10 having the door 62 closed.

The lid assembly 60 may include a lid 62, a handle 64, and prongs 66. The lid 62 may substantially have a rectangular shape. It also may be suitable for the lid 62 to have a cylindrical shape, a triangular shape, or any other suitable shape. The lid 62 may be made of glass, polyurethane, or any other suitable material. The lid 62 may be transparent. The prongs 66 may be cylindrical portions protruding from the top lateral sides of the lid 62. The prongs 66 may engage with the slots 44*a*. The prongs 66 may slide backwards through the slots 44*a* as the lid 62 is lifted. As best illustrated in FIG. 1A, the lid 62 may cover a front portion of the present invention 10 in the closed configuration. The lid 62 may be supported by the stops 24. As best illustrated in FIG. 2, the lid 62 may be slided into the present invention 10 so that the lid is introduced therein parallel to a top wall 83. The handle 64 may have a rectangular shape. The handle 64 may be horizontally disposed on a front-bottom portion of the lid 62. The handle 64 may be used to open the lid 62.

Referring now to FIG. 3 it can be shown that the rear wall assembly 80 may include a rear wall 82 and the top wall 83. The rear wall 82 may have a rectangular shape. The rear wall 82 may include a front portion 84. The front portion 84 may have a rectangular shape. The front portion 84 may be located on a central front portion of the rear wall 82 defining slots on the right and left sides. The sidewalls 42 may be coupled to the right side and left side. The top wall 83 may have a rectangular shape. It also may be suitable for the top wall 83 to have a triangular shape, a circular shape, or any other shape. The top wall may be made of polyvinyl chloride, polyurethane, or any other suitable material. It should be understood that the sidewalls 42, the rear wall 82, the top wall 83, the base 22, and the lid 62 may be arranged together using fasteners, adhesive or any other means defining a cooling cabinet with lid 62. Racks may be introduced into the present invention and rest on the shelves 46 so content introduced therein can be cooled. Channel 32 may have dimensions that cooperate to receive the rear wall 82, and the sidewalls 42. It should be understood that the top wall 83 may also include a second channel extending a length of a rear portion, left portion and right portion of the top wall. The channel of top wall 83 may have dimensions that cooperate to receive the rear wall 82 and the sidewalls 42. It should be understood that additional elements may be implemented in the present invention 10. For instance, the present invention 10 may include electric circuit, controllers, actuators, and a power cord which are widely known in the art and were obviated. The present invention 10 includes walls and a base fluidically connected to allow air to be evenly distributed within the present invention 10.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A cooling cabinet, comprising:

a base assembly including a base having a condenser therein, said condenser configured to dispense a cool flow of air, wherein said base includes a continuous channel on a top portion thereof extending along a perimeter of said base including a rear portion, right portion, and left portion, said channel having an angled inner wall configured as an airflow distribution piece;

a sidewalls assembly including hollow sidewalls having second openings on lateral sides thereof and third openings on bottom portions thereof, said sidewalls including horizontal shelves protruding from inner surfaces thereof, wherein said sidewalls are received within said channel for detachable connection;

a rear wall assembly including a rear wall and a top wall, wherein said rear wall, said top wall, said sidewalls, and said base are detachably attached together in an assembled configuration and can be disassembled for storage;

a lid assembly including a lid having prongs extending from top lateral sides thereof, said prongs configured to engage with slots extending along top ends of said sidewalls and slide backwards through said slots when said lid is lifted to provide access to said cabinet; and wherein said sidewalls include angled protrusions extending within hollow interiors thereof between adjacent second openings, said angled protrusions functioning as baffles to redirect said cool flow of air from said third openings toward said second openings.

2. The cooling cabinet of claim 1, wherein said base assembly further includes a fan positioned within said base opposite to said condenser, said fan actuated to increase speed of said cool flow of air.

3. The cooling cabinet of claim 1, wherein said base includes a grid positioned on a central top portion thereof, said cool flow of air dispensed through said grid.

4. The cooling cabinet of claim 1, wherein said channel includes first openings positioned on a top-right portion and a top-left portion of said base, said cool flow of air flowing from said base through said first openings to said third openings.

5. The cooling cabinet of claim 1, wherein said shelves comprise rectangular elongated portions horizontally disposed on lateral walls of said sidewalls, said shelves positioned opposite each other and horizontally aligned to support trays.

6. The cooling cabinet of claim 1, wherein said lid is transparent and includes a handle positioned on a front-bottom portion thereof.

7. The cooling cabinet of claim 1, wherein said base includes a control panel configured to control temperature, fan speed, and operation time, said control panel including buttons and a display.

8. The cooling cabinet of claim 1, wherein said channel has a rectangular cross-sectional shape and said angled inner wall redirects airflow upward and laterally for enhanced airflow uniformity.

9. The cooling cabinet of claim 1, wherein said prongs are configured to be completely removable from said slots to detach said lid from said sidewalls for disassembly and storage.

10. The cooling cabinet of claim 1, further comprising stops positioned on a top-front portion of said base, said stops configured to support said lid in a closed configuration.

11. The cooling cabinet of claim 1, wherein said angled protrusions extend inwardly into said hollow interiors and are oriented to provide bidirectional lateral airflow distribution.

12. The cooling cabinet of claim 1, wherein said channel includes upper and lower shoulders, and said sidewalls include flanges that engage both said upper and lower shoulders for secure detachable assembly.

13. A cooling cabinet, consisting of:

a hollow base having a condenser therein and a peripheral channel with an angled inner wall configured as an airflow distribution piece;

hollow sidewalls configured to be received within said peripheral channel, said sidewalls having lateral openings for dispensing cool air, bottom openings fluidly connected to said base, and internal baffles positioned between adjacent lateral openings;

horizontal shelves protruding from inner surfaces of said sidewalls at multiple levels; and a lid having prongs that engage with elongated slots in top portions of said sidewalls, wherein said prongs require upward lift before rearward sliding for lid operation.

14. The cooling cabinet of claim 13, wherein said internal baffles comprise angled protrusions that redirect airflow upward and laterally to reduce localized hotspots.

15. The cooling cabinet of claim 13, wherein said peripheral channel receives bottom portions of said sidewalls and a rear wall to provide both structural support and airflow communication.

16. The cooling cabinet of claim 13, wherein said angled inner wall of said peripheral channel enhances airflow uniformity compared to straight wall channels.

17. The cooling cabinet of claim 13, wherein said condenser and a fan are positioned at opposite ends within said base to optimize airflow distribution.

18. The cooling cabinet of claim 13, wherein said internal baffles are integrally formed with walls of said sidewalls.

19. A method of assembling a detachable cooling cabinet, comprising:

providing a base having a peripheral channel with an angled inner wall and a condenser and a fan therein;

inserting sidewalls into said peripheral channel such that flanges of said sidewalls engage shoulders of said channel;

positioning a rear wall within said peripheral channel adjacent to said sidewalls;

engaging prongs of a lid with elongated slots in top portions of said sidewalls by upward lift and rearward sliding; and activating said condenser and said fan to circulate cool air through internal baffles within said sidewalls.

20. The method of claim 19, further comprising completely removing said prongs from said slots to detach said lid for compact storage of disassembled components.

* * * * *